US010898020B2

(12) United States Patent
Lee

(10) Patent No.: US 10,898,020 B2
(45) Date of Patent: Jan. 26, 2021

(54) ADJUSTABLE OVER-THE-DOOR HANGER ASSEMBLY

(71) Applicant: HLD GLOBAL LIMITED, Hong Kong (HK)

(72) Inventor: Po Sum Lee, Hong Kong (HK)

(73) Assignee: HLD GLOBAL LIMITED, Kowloon (HK)

( * ) Notice: Subject to any disclaimer, the term of this patent is extended or adjusted under 35 U.S.C. 154(b) by 0 days.

(21) Appl. No.: 16/361,828

(22) Filed: Mar. 22, 2019

(65) Prior Publication Data

US 2020/0297140 A1 Sep. 24, 2020

(51) Int. Cl.
*A47G 25/06* (2006.01)

(52) U.S. Cl.
CPC ..... *A47G 25/0614* (2013.01)

(58) Field of Classification Search
CPC ..... A46G 25/0614; A46G 25/1457; A47G 25/0614; A47G 25/1457; A47G 25/0607; A47G 25/145; A47G 7/044; A47G 7/045; F16B 45/00; Y10S 224/927
USPC ..... 211/113, 118, 119.004; 248/224.8, 248/225.11, 229.12, 229.22, 228.3, 248/231.41, 215, 322, 339, 340; D8/367, D8/373; D6/323
See application file for complete search history.

(56) References Cited

U.S. PATENT DOCUMENTS 585,471 A * 6/1897 Hannegan ..... A47H 1/13 248/260
1,055,201 A * 3/1913 Mason ..... A47B 57/567 248/244
3,224,715 A * 12/1965 Maggiore ..... A47G 1/1653 248/467
3,544,049 A * 12/1970 Ribble ..... F16L 3/23 248/68.1
4,123,024 A * 10/1978 Levy ..... A47G 25/06 211/119.004

(Continued)

FOREIGN PATENT DOCUMENTS

EP 0518193 A1 * 12/1992 ..... A47G 7/044
GB 365734 A * 1/1932 ..... A47G 25/0614

OTHER PUBLICATIONS

SD Designs Clear Over the Door Hook—Adjustable Width, SD Designs [retrieved on Sep. 26, 2019]. Retrieved from the internet: <URL: https://www.amazon.com/Clear-Over-Door-Hook-Adjustable/dp/B00BZB47X4>.

*Primary Examiner* — Jonathan Liu
*Assistant Examiner* — Guang H Guan
(74) *Attorney, Agent, or Firm* — Abelman, Frayne & Schwab

(57) ABSTRACT

A two-piece adjustable over-the-door hanger assembly includes (i) a generally L-shaped stationary member having a mounting leg positionable on a top edge of a door and a depending leg, and (ii) a generally L-shaped locking member having a supporting leg and a generally planar engagement leg terminating in a hook and dimensioned to pass through one of a plurality of transverse slots in a longitudinal central opening in the mounting leg to position the engagement leg proximate to a surface of the door and to bring the supporting leg into contact with the mounting leg over the door. The engagement leg is configured and dimensioned for rotation when positioned normal to the longitudinal opening to permit a relatively wider proximal portion to pass in sliding engagement through one of the transverse slots.

20 Claims, 5 Drawing Sheets

(56) References Cited

U.S. PATENT DOCUMENTS

| | | | | |
|---|---|---|---|---|
| 4,387,873 | A | 6/1983 | Pavlo et al. | |
| 4,417,712 | A * | 11/1983 | DeHart | G09F 7/18 248/220.22 |
| 4,494,296 | A * | 1/1985 | Grimes | F24F 7/007 174/63 |
| 5,368,267 | A | 11/1994 | Howard | |
| 5,738,319 | A | 4/1998 | Grassi | |
| 5,743,497 | A * | 4/1998 | Michael | F16L 3/223 248/316.7 |
| 5,779,206 | A | 7/1998 | Harris et al. | |
| 6,012,690 | A * | 1/2000 | Cohen | A47G 7/044 248/214 |
| 6,168,125 | B1 * | 1/2001 | Winger | A47G 7/044 248/228.3 |
| 6,349,911 | B1 * | 2/2002 | Feldpausch | A47B 57/34 211/90.02 |
| 6,364,260 | B1 | 4/2002 | Lorincz et al. | |
| 7,207,088 | B2 | 4/2007 | Adams et al. | |
| 7,229,056 | B2 | 6/2007 | Rosser et al. | |
| 7,992,833 | B1 | 8/2011 | Goodman et al. | |
| 8,534,627 | B2 * | 9/2013 | Kressin | A47G 1/1653 248/307 |
| 9,307,700 | B1 | 4/2016 | Schmitt | |
| 2003/0173483 | A1 | 9/2003 | Yen | |
| 2005/0017142 | A1 * | 1/2005 | Ogden | E04D 13/1625 248/247 |
| 2007/0205346 | A1 | 9/2007 | Jackson et al. | |
| 2015/0238027 | A1 | 8/2015 | Yen | |
| 2016/0003375 | A1 * | 1/2016 | Robertson, Jr. | E21D 17/02 248/341 |
| 2020/0297140 | A1 * | 9/2020 | Lee | A47G 25/0614 |

* cited by examiner

ADJUSTABLE OVER-THE-DOOR HANGER ASSEMBLY

FIELD OF THE INVENTION

This disclosure relates to adjustable width over-the-door hangers.

BACKGROUND OF THE INVENTION

Over-the-door hangers are configured with a hook that is adapted to support one or more articles of clothing, clothing hangers, shoe bags, and other closet organizers out of sight on the interior of the closet door. One-piece hanger units are designed to securely rest on the top of a typical residential door having a thickness of about 1⅜ inches, and cannot be made to function with thicker doors, such as metal entry doors, fire-resistant doors and other non-standard doors that are commonly found in commercial and institutional settings.

Adjustable width over-the-door hanger assemblies are available that can be used with doors of various thicknesses and without prior knowledge of the actual thickness at the time of purchase. In general, these prior art assemblies consist of two L-shaped parts that are configured to slidingly engage each other either along their longitudinal axis or laterally when the respective legs are horizontally positioned on the top edge of the door and the depending legs are in contact with the opposing front and rear sides of the door. In one commercially available version, the overlying horizontal legs are provided with a plurality of projecting detents and corresponding openings or grooves which engage to maintain the depending legs in a fixed position to thereby secure the assembly in place on the door with the hook projecting to receive and support the organizer or articles of clothing. In another version, one of the legs is provided with a number of transverse grooves which receive mating projections formed on the other leg that permit adjustment of the distance between the depending legs.

At the point of purchase, the two parts may not assembled in order to minimize the size of the shipping and display package. In preparing the two parts for use, the horizontal legs must be assembled in their close-fitting sliding configuration. The assembly step may prove to be difficult for those with limited manual dexterity, poor eyesight, arthritis, and/or other physical disabilities.

The cost of manufacturing the two interlocking parts of the prior art assemblies which must engage with relatively close tolerances and that include a number of small detents and openings is considerably greater than the one-piece fixed-width over-the-door hangers.

The problems addressed by the present invention are to provide an adjustable two-piece over-the-door assembly (i) where the two pieces can be quickly and easily assembled in the desired position by the user at the time of installation on the top of the door without having to perform the customary assembly and adjustment of the horizontal pieces in their close-fitting sliding engagement; and (ii) where both of the parts of the assembly can be economically fabricated using conventional automated metal working machines and a limited number of punch and die sets, or plastic injection molding machines.

SUMMARY OF THE INVENTION

The above problems are addressed and other advantages are achieved by the two-piece adjustable width over-the-door hanger of the present invention which comprises (i) an L-shaped stationary member having a generally planar mounting leg which is configured for mounting on the top edge of a door and a contiguous depending leg that forms a 90° angle with the mounting leg, and (ii) an L-shaped locking member having a generally planar engagement leg terminating in one or more hooks and a contiguous supporting leg that forms a 90° angle with the engagement leg. The engagement leg is vertically oriented in use and is dimensioned and configured to pass at a right angle through one of a plurality of transverse slots formed in an outboard or distal portion of the mounting leg of the stationary member to position the inside surface of the engagement leg opposite the hook vertically aligned and in contact with, or in close proximity to the surface of the door when the depending leg of the stationary member is positioned in contact with the opposite side of the door, and to bring the underside of the supporting leg into resting contact with a portion of the upper surface of the horizontal mounting leg that extends in an inboard direction, i.e., away from the free end of the mounting leg of the stationary member.

In a preferred embodiment of the hanger assembly of the invention, the plurality of transverse slots are bisected by a central longitudinal opening in the stationary member, the opposing ends of the longitudinal opening being coincident with a transverse slot. The engagement leg of the locking member is configured and dimensioned so that the distal end that terminates in one or more hooks, or other supporting configurations can be rotated freely when positioned normal to the longitudinal opening to permit a relatively wider proximal portion adjacent the supporting leg to pass in close-fitting sliding engagement through one of the transverse slots and to lower the supporting leg into resting contact with the horizontal mounting leg of the stationary member. It will be understood that the length of the longitudinal slot and the number of transverse slots is predetermined to accommodate a wide range of door thicknesses with which the assembly is adapted for use. The assembly can be configured and dimensioned for use with doors ranging in thickness from about 1.25 inches to 2 inches, or even greater.

Thus, the two-piece adjustable over-the-door hanger assembly of the present disclosure comprehends a. an L-shaped first member formed by
   (i) a depending section configured and dimensioned to contact a first vertical side of a door and extending downwardly a predetermined distance from the top of the door, and
   (ii) a contiguous horizontal section extending at a right angle from the depending section with a first portion configured and dimensioned to contact the top edge of the door and a second portion that extends beyond the top edge of the door, the second portion formed with an elongated opening extending a predetermined distance along the longitudinal axis of the horizontal section and a plurality of spaced-apart slots of uniform predetermined width extending transversely across the central axis of the elongated opening, the engagement section terminating in an outwardly projecting hook, and b. an L-shaped second member formed by a
   (i) vertical engagement section configured and dimensioned to slidingly engage one of the transverse slots in close-fitting relation to position a side of the engagement section in close proximity to the side of the door opposite the depending section, the engagement section terminating in an outwardly projecting hook and (ii) a contiguous supporting section extending at a right angle from the engagement section and configured to contact the horizontal section of the first member when the engagement section is placed in position in one of the transverse slots to secure the assembly on the top edge of the door.

In use, the transverse slot that will provide the most secure mounting position for the assembly on the top edge of the door can most conveniently be determined by the user by making the adjustment on the vertical edge of the open door. This is done by maintaining the depending leg against one side of the door with the mounting leg in contact with the vertical edge of the door and visually determining which of the transverse slots is closest to the door surface and inserting the engagement leg of the locking member into the slot to position it against the surface of the door with the hook extending out. The assembly can then be held together by the user with one hand and placed over the top of the door in the desired location for service in supporting one side of an organizer, or as a clothing hanger. Alternatively, the user can measure the thickness of the door with, e.g., a rule and then determine the transverse slot that is closest to the measured dimension.

BRIEF DESCRIPTION OF THE DRAWINGS

The invention will be described in more detail below and with reference to the attached drawings in which the same numeral will be used to refer to the same or similar elements, and where.

DETAILED DESCRIPTION OF THE INVENTION

Figure 1:
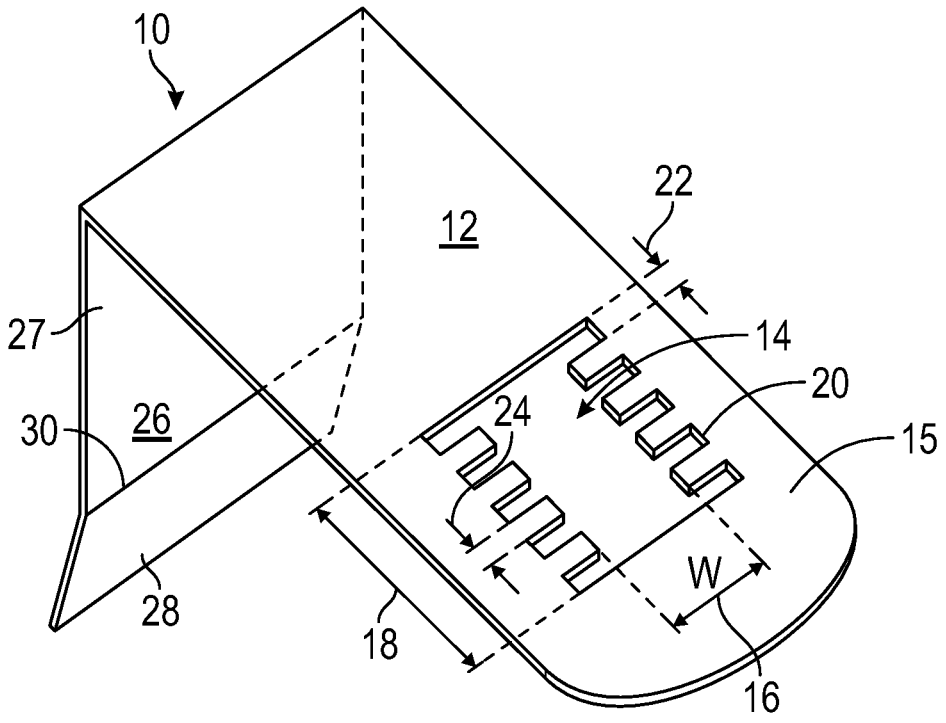
FIG. 1 is a front, top right side perspective view of an embodiment of a stationary member of the two-piece adjustable over-the-door hanger assembly in accordance with the present disclosure.
Figure 5:
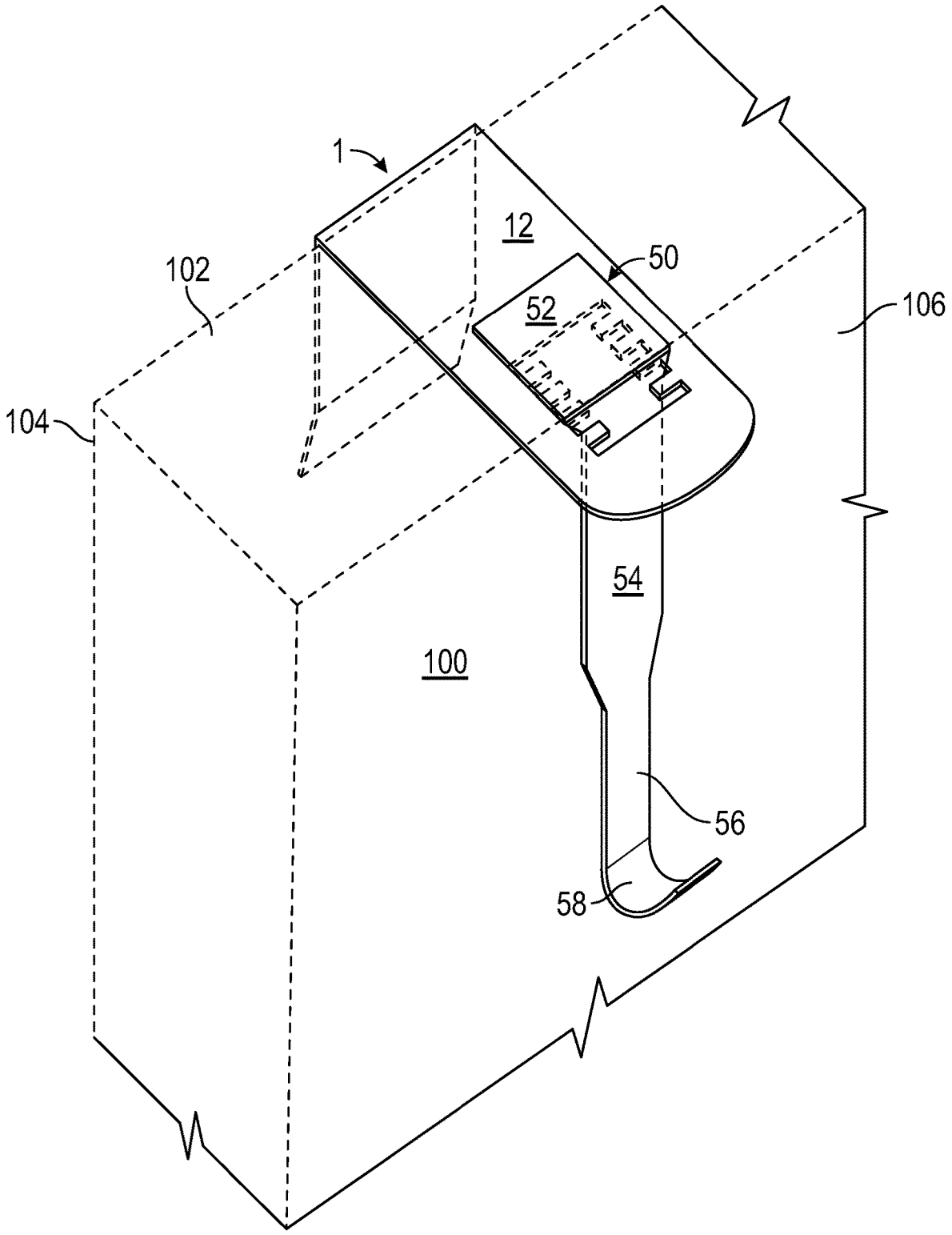
FIG. 5 is a top, front right side perspective view, partly in phantom, showing the assembly installed on the top edge of a door.

The two-piece adjustable over-the-door hanger assembly of the present disclosure will be described initially with reference to FIGS. 1, 2A, 2B and 5. Referring first to FIG. 1, the stationary member (10) is comprised of mounting leg (12) joined at a right angle to depending leg (26), In use, the mounting leg (12) is positioned on the top edge of the door with the depending leg (26) in contact with a vertical surface of the door. A longitudinal opening (14) of a width "W" (16) extends along the central longitudinal axis of mounting leg (12) a predetermined distance (18) that corresponds to the range of door thickness for which the assembly (1) as shown in FIG. 5 is intended for use. A plurality of transverse slots (20) each of predetermined width (22) extends across the longitudinal opening (14) to define the equivalent number of door thicknesses with which the assembly can be used. The space (24) between the slots (20) as shown is uniform. In a preferred embodiment illustrated, the center of the slots at either end of the horizontal opening in the distal end (15) of the mounting leg (12) are coincident with the end walls of the opening.

As will be understood by one of ordinary skill in the art, the dimensions of longitudinal opening (14), the transverse slots (20), the thickness of the material of construction of the metal and/or plastic parts will be determined to assure a robust construction, i.e., with sufficient rigidity to prevent deformation, e.g., along one of the transverse slots where the rigidity of the mounting leg (12) of the stationary member (10) is reduced at its opposing outer margins.

Likewise, the combined thickness of the mounting leg (12) and supporting leg (52) must be predetermined to avoid contact with the adjacent horizontal door jam when the stationary member is in position on the top edge of the door. As will be understood, these are design and fabrication considerations that are well within the skill in the art.

With continuing reference to FIG. 1, the terminal portion (28) of depending leg (26) extends at an obtuse angle defined by transverse line (30) out of the plane of the upper portion of the depending leg (26) and away from the vertical surface of the door when the assembly is mounted. The obtuse angle defined by the two portions (27, 28) of depending leg (26) is not critical and can range from about 150° to 160°. The purpose of this configuration is to avoid scratching or otherwise marring the surface finish of the door during installation and/or movement of the assembly (1) on the top of the door. In this regard, all of the edges and corners of the parts comprising the assembly are preferably rounded and provided with a smooth finish to avoid injury to the user and/or to the finished surface of the door upon which the assembly is mounted.

Figure 2A:
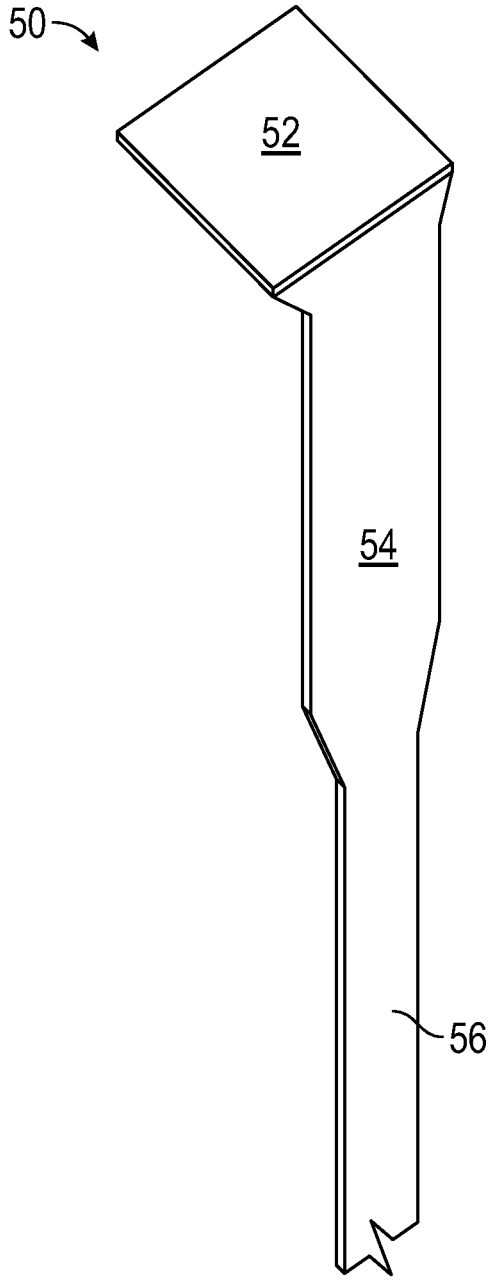
FIG. 2A is a front, top right side truncated perspective view of an embodiment of a locking member without the hook portion, dimensioned and configured for engagement with the stationary member of FIG. 1.
Figure 2B:
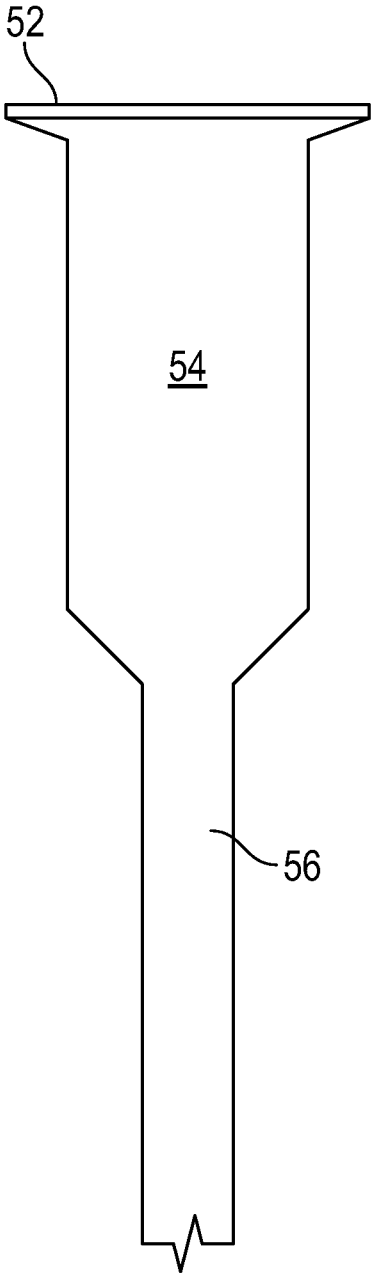
FIG. 2B is a front elevation of the locking member of FIG. 2A.

Referring now to FIG. 2A, a locking member (50) is comprised of supporting leg (52) which is joined at a right angle to engagement leg (54), the latter as shown includes a transverse terminal portion (56) which is narrower than the upper portion of engagement leg (54) that is adjacent the supporting leg (52). In the truncated views of FIGS. 2A and 2B, the hook (58) shown in FIG. 5 has been omitted for convenience and the feature will discussed in more detail below.

As will be understood by one of ordinary skill in the art, both the stationary member (10) and the locking member (50) can economically be fabricated from any of a variety of metal sheet or plate materials, e.g., by stamping and punch-and-die machines, as well as other metal working equipment that is well known in the art. Alternatively, the assembly members (10, 50) can economically be fabricated by injection molding, heat forming and shaping of polymer blanks, and other methods that are well known in the manufacture of plastic articles.

Referring now to FIG. 5, the two members (10, 50) are illustrated in the configuration of the assembly (1) in position on a door (100) with the stationary member (10) in a horizontal position with depending leg (26) positioned against the vertical surface (104) of the door. (100) and the distal end of the mounting lea (12) extending outwardly beyond the opposite face (106) of the door (100) along with two of the distal transverse slots. As will be understood, FIG. 5 is intended to be illustrative and the size and number of transverse slots and their width can be more or less than those shown in the representative embodiment of FIG. 5.

The locking member (50) has been inserted into the second from the last transverse slot (20) which as shown, extends beyond the face of the door (106) below. This position was selected to place the rear surface of the engagement leg (54) in contact with, or in close proximity to the door surface (106) and the hook (58) projecting outwardly for use in receiving an article to be hung against that face of the door. The supporting leg (52) is resting on the upper surface of the mounting leg (12) of stationary member (10).

As is apparent from FIG. 5, the locking member (50) cannot be inserted directly into the position shown due to the configuration and orientation of the projecting hook (58) and supporting leg (52). The method of assembling the two members (10) and (50) in preparation for use of the assembly (1) will be explained in conjunction with FIGS. 3 and 4.

Figure 3:
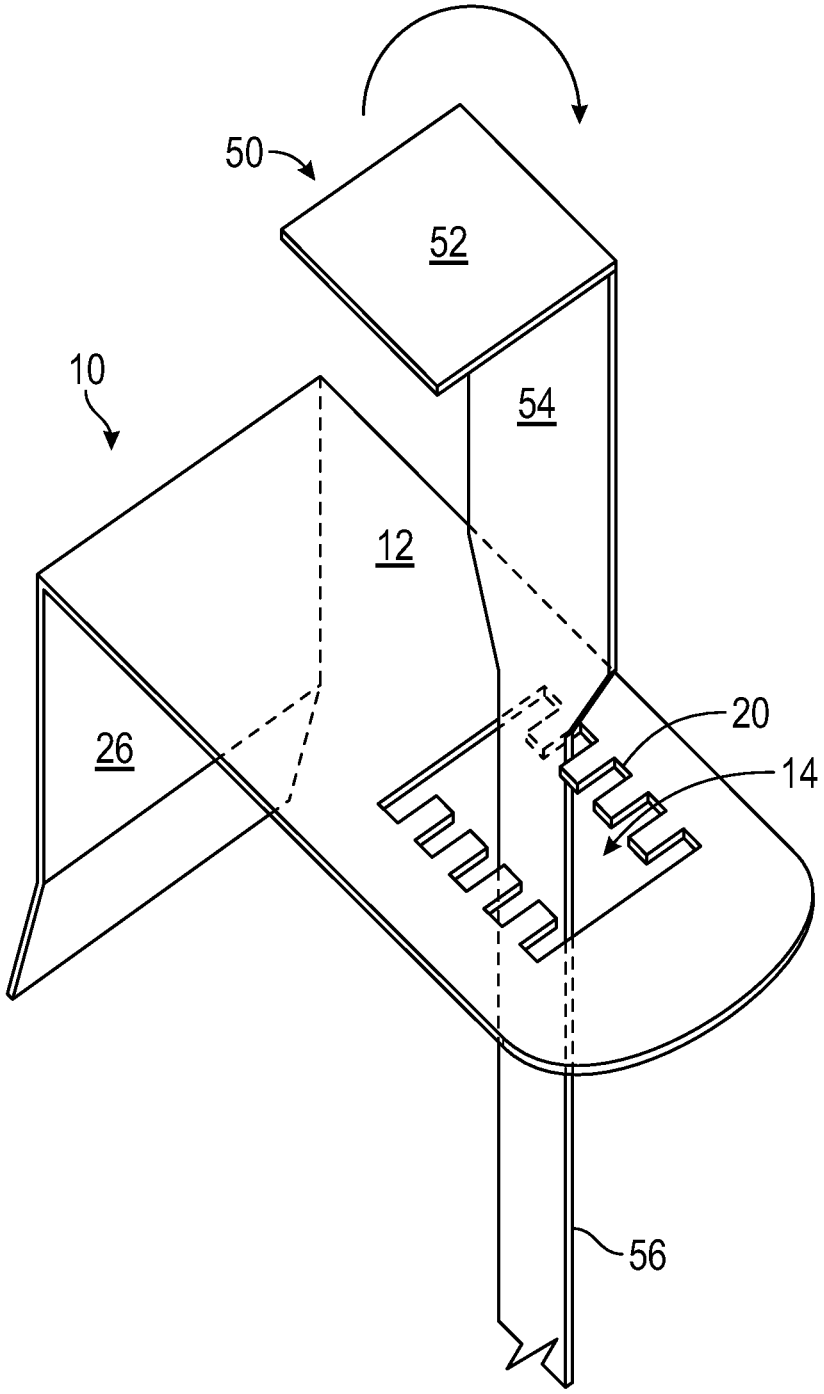
FIG. 3 is a perspective view illustrating a first intermediate step in the assembly of rotating the locking member of FIG. 2A with respect to the stationary member of FIG. 1.
Figure 4:
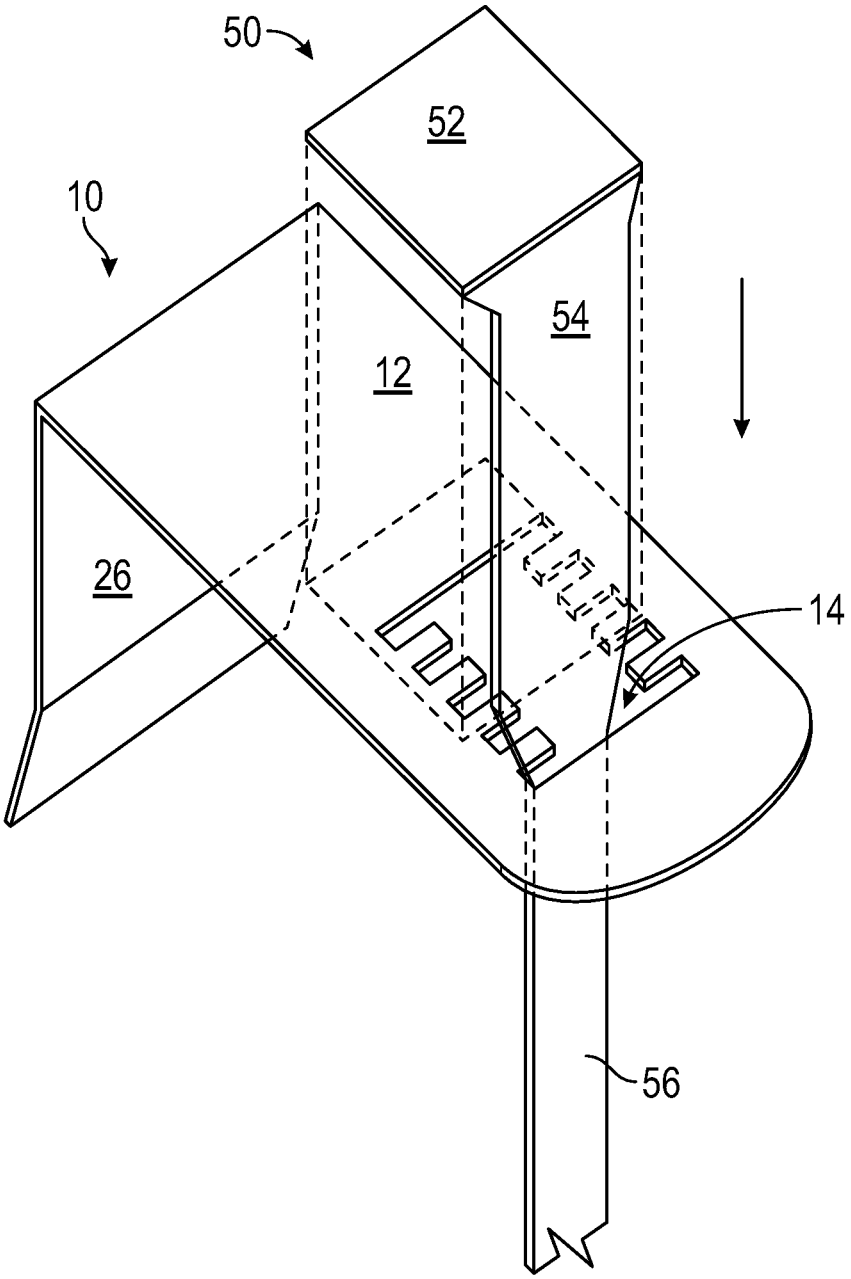
FIG. 4 is an exploded view similar to FIG. 4 illustrating the positioning of the rotated locking member prior to final engagement with the stationary member.

With reference to FIG. 3, it will be understood that the supporting leg (52) is able to pass vertically through the longitudinal opening (14) when its planar surface is aligned with the axis of the longitudinal opening (14). When the narrower terminal portion (56) of engagement leg (54) is in position in the longitudinal opening (14), it can rotate in the longitudinal opening between the transverse slots (20) to position the supporting leg (52) above the mounting leg (12), With the engagement leg thus rotated 90°, the wider upper portion of engagement leg (54), which is configured and dimensioned to pass in close-fitting sliding engagement with the transverse slots (20), can be lowered as shown in FIG. 4 to define the horizontal distance between the depending leg (26) of stationary member (10) that most nearly corresponds to the thickness of the door (100), As explained above, the selection of the appropriate transverse slot 20 for insertion of the engagement lea (54) can also conveniently be accomplished by positioning the assembly on a vertical edge of the door and visually selecting the appropriate slot and manually maintaining the supporting leg (52) in position on the mounting leg (12) while placing the assembly (1) over the top edge of the door as shown in FIG. 5.

In an alternative embodiment, (not shown) the width of the engagement leg corresponding generally to element (54) of locking member (50) is of uniform width, i.e., without the reduction of the corresponding terminal portion (56) as shown in FIGS. 2-5, and dimensioned to slidingly engage the transverse slots (20) in close-fitting relation as described above. It will be understood that the user will be required to select the transverse slot before placing the assembly on the top edge of the door. The appropriate transverse slot that will position this modified embodiment of engagement leg (54) in contact with, or in close proximity to the vertical surface of the door can most conveniently be determined by placing the stationary member on a side edge of the door at about eye level and visually identifying the appropriate transverse slot, inserting the end of the hook portion (58) into the selected slot and bringing the supporting leg (52) of locking member (50) into contact with the mounting leg (12). The assembly can then be placed on the top edge (102) of the door (100) as was described above, which may require the use of a stepstool or ladder due to the height of the door above the floor.

The invention has been described in detail above and further illustrated in the attached drawings and modifications will be apparent to those of ordinary skill in the art from this disclosure. The scope of the invention is therefore to be determined with reference to the attached claims.

The invention claimed is:

1. An adjustable over-the-door hanger assembly consisting of:

a. a one-piece generally L-shaped stationary member consisting of:

(i) a planar mounting leg configured to transversely overlay a top edge of a door, the planar mounting leg comprising an end portion configured to extend beyond a first side of the door, the planar mounting leg formed with an elongated longitudinal opening and a plurality of spaced-apart transverse slots extending across the elongated longitudinal opening, the plurality of spaced-apart transverse slots each having a predetermined width, and (ii) a depending leg extending contiguously from the planar mounting leg, the depending leg comprising a planar top portion that forms a 90° angle with the planar mounting leg and is configured to contact a vertical surface of a second side of the door below the top edge of the door and opposite the first side of the door, and b. a one-piece locking member consisting of:

(i) a planar supporting leg configured to overlay a portion of the planar mounting leg, the planar supporting leg extending away from the elongated longitudinal opening, (ii) a planar engagement leg extending contiguously from the planar supporting leg, the planar engagement leg forming a 90° angle with the planar supporting leg and terminating in a distal portion, wherein an upper end portion of the planar engagement leg adjacent the planar supporting leg is configured and dimensioned to slidingly engage an end wall of one of the plurality of spaced-apart transverse slots in close-fitting relation when the planar supporting leg is positioned in contact with an upper surface of the planar mounting leg and the planar engagement leg is positioned in close proximity to a vertical surface of the first side of the door to securely mount the adjustable over-the-door hanger assembly on the door, and (iii) a hook structure extending from the distal portion of the planar engagement leg.

2. The adjustable over-the-door hanger assembly of claim 1, wherein a lower end portion of the planar engagement leg remote from the planar supporting leg is dimensioned and configured to pass through the elongated longitudinal opening and rotate to position the upper end portion of the planar engagement leg in one of the plurality of spaced-apart transverse slots to securely mount the adjustable over-the-door hanger assembly on the door.

3. The adjustable over-the-door hanger assembly of claim 1, wherein the hook structure is configured as a J-hook, a V-hook, or an L-hook.

4. The adjustable over-the-door hanger assembly of claim 1, wherein the depending leg includes a terminal portion that is displaced outwardly at an obtuse angle to, and along a line transverse to, a longitudinal axis of an adjoining top portion of the depending leg.

5. The adjustable over-the-door hanger assembly of claim 4, wherein the obtuse angle is between 150° and 160°.

6. The adjustable over-the-door hanger assembly of claim 4, wherein the length of the terminal portion of the depending leg is from one-third to one-quarter of the total length of the depending leg.

7. The adjustable over-the-door hanger assembly of claim 1, wherein the planar mounting leg has a length that is in a range from 2.25 inches to 2.5 inches and wherein the length of the elongated longitudinal opening is in a range from 0.35 inches to 0.60 inches.

8. The adjustable over-the-door hanger assembly of claim 1, wherein the plurality of spaced-apart transverse slots includes a first transverse slot that is coincident with a first end of the elongated longitudinal opening and a second transverse slot that is coincident with a second end of the elongated longitudinal opening opposite the first end of the elongated longitudinal opening.

9. The adjustable over-the-door hanger assembly of claim 1, wherein the planar engagement leg and the hook structure have a combined vertical length between 3.25 inches and 3.5 inches.

10. The adjustable over-the-door hanger assembly of claim 1, wherein the plurality of spaced-apart transverse slots includes a first transverse slot that is located at a distance from an inside corner of the one-piece generally L-shaped stationary member and wherein the distance is selected to correspond to the width of an interior door.

11. The adjustable over-the-door hanger assembly of claim 1, wherein the plurality of spaced-apart transverse slots comprises at least two adjacent transverse slots and wherein the distance between the at least two adjacent transverse slots is in a range from 0.045 inches to 0.055 inches.

12. The adjustable over-the-door hanger assembly of claim 1, wherein the predetermined width of each of the plurality of spaced-apart transverse slots is dimensioned and configured to receive the upper end portion of the planar engagement leg adjacent the planar supporting leg in close-fitting sliding engagement to securely mount the adjustable over-the-door hanger assembly on the door.

13. The adjustable over-the-door hanger assembly of claim 1, wherein opposing sides of a lower portion of the planar engagement leg are parallel and wherein the lower portion of the planar engagement leg has a width that is less than the width of the elongated longitudinal opening.

14. The adjustable over-the-door hanger assembly of claim 1, wherein the one-piece generally L-shaped stationary member is metal and wherein the elongated longitudinal opening and the plurality of spaced-apart transverse slots are formed by die-cutting.

15. The adjustable over-the-door hanger assembly of claim 1, wherein one or both of the one-piece generally L-shaped stationary member and the one-piece locking member are formed by injection molding of a polymeric composition having high impact strength.

16. The adjustable over-the-door hanger assembly of claim 15, wherein the one or both of the one-piece generally L-shaped stationary member and the one-piece locking member are resilient with high impact strength.

17. An over-the-door hanger assembly consisting of:

a. a generally L-shaped first member consisting of:

(i) a depending section configured and dimensioned to contact a first vertical side of a door and extending downwardly a predetermined distance from a top edge of the door, and (ii) a horizontal section extending contiguously at a right angle from the depending section, the horizontal section having a first portion configured and dimensioned to contact the top edge of the door and a second portion configured to extend beyond the top edge of the door, the second portion formed with an elongated longitudinal opening extending a predetermined distance along a longitudinal axis of the horizontal section and a plurality of spaced-apart transverse slots of a uniform predetermined width, and b. a generally L-shaped second member consisting of:

(i) a vertical engagement section configured and dimensioned to slidingly engage one of the plurality of spaced-apart transverse slots in close-fitting relation to position a side of the vertical engagement section in close proximity to a second vertical side of the door opposite the depending section, (ii) a supporting section extending contiguously at a right angle from the vertical engagement section and configured to contact the horizontal section when the vertical engagement section is placed in position in one of the plurality of spaced-apart transverse slots to secure the over-the-door hanger assembly on the top edge of the door, and (iii) an outwardly projecting hook extending from the vertical engagement section.

18. The over-the-door hanger assembly of claim 17, wherein the width of a distal end portion of the vertical engagement section is less than the width of the elongated longitudinal opening.

19. The over-the-door hanger assembly of claim 17, wherein the plurality of spaced-apart transverse slots includes a first transverse slot that is coincident with a first end of the elongated longitudinal opening and a second transverse slot that is coincident with a second end of the elongated longitudinal opening.

20. The over-the-door hangar assembly of claim 17, wherein the plurality of spaced-apart transverse slots includes a first transverse slot that is located at a selected distance away from an inside corner of the generally L-shaped first member and wherein the selected distance is selected to correspond to the width of the door.

* * * * *